United States Patent [19]

Jensen et al.

[11] 4,053,058

[45] Oct. 11, 1977

[54] SUSPENDED EXTENSIBLE BOOM

[75] Inventors: Lyle B. Jensen; C. Wayne Powers, both of Cedar Rapids, Iowa

[73] Assignee: FMC Corporation, San Jose, Calif.

[21] Appl. No.: 691,045

[22] Filed: May 27, 1976

[51] Int. Cl.[2] ..... B66C 23/00

[52] U.S. Cl. ..... 212/8 R; 212/59 R; 212/144

[58] Field of Search ..... 212/8 R, 8 A, 55, 59 R, 212/144, 49

[56] References Cited

U.S. PATENT DOCUMENTS

| | | | |
|---|---|---|---|
| 2,819,803 | 1/1958 | Obenchain | 212/55 |
| 3,648,850 | 3/1972 | Rochon et al. | 212/55 |

*Primary Examiner*—Lawrence J. Oresky
*Attorney, Agent, or Firm*—J. F. Verhoeven; J. W. Edwards; C. E. Tripp

[57] ABSTRACT

An extensible boom has a base section that is pivotally connected to a machinery platform and at least one section that is movable axially relative to the base section. A cable system is provided for extending and for retracting the movable sections. The boom sections can be jammed together in either an extended position or a retracted position to resist compression axially of the boom, and to resist bending transversely of the longitudinal axis of the boom in a generally vertical plane. A live mast is offset from the base end of the boom in a vertical plane. Boom carrying ropes extend between the distal end of the base section and the live mast, while a boom pendant extends between the live mast and the distal end of the tip section of the boom. Support of the boom can be transferred by alternately tensioning and slackening the boom carrying ropes and the boom pendant. The boom is supported by the boom carrying ropes during traveling, unpinning, extension, retraction, and pinning of the boom sections, while the boom is supported by the boom pendant when the boom sections have been pinned together and are ready for supporting loads with the boom.

10 Claims, 13 Drawing Figures

29
5
6
180
77
33
187
57
84
48
37
49
93
62
41
V
D
S
92
C2
51
99
50
C
98
44
66
53
105
52
104
70
39
36
32
43
192
178
182
181
190
186
196
194
183
94
95
34
91
60
90
100
101
38
64
96
97
106
107
42
102
103
68
188
45

SUSPENDED EXTENSIBLE BOOM

BACKGROUND OF THE INVENTION

1. Field of the Invention

This invention relates to extensible booms for cranes and the like. More specifically, the invention concerns a suspended boom with movable sections that can be readily extended and these sections can be pinned together in desired positions. The invention also pertains to the method of changing the length of the extensible boom.

2. Description of the Prior Art

At one time, crane booms were transported to a job site in sections and it was necessary to put the sections together to form a boom of a desired length. If a longer length was desired, it was necessary to put additional sections in the boom and the process of lengthening the boom involved a considerable amount of time and effort by a crew of workmen. If, after assembling the boom to the desired length, the boom was found to be too long to raise in the place where it was needed, more time was lost while the boom sections were changed, as required, to shorten the length of the boom.

Extensible booms were developed to facilitate the rapid extension or retraction of a boom at a work site. One common type of extensible boom utilizes hydraulic cylinders for extending the movable boom sections. These booms are heavy because the movable sections are supported as cantilevers and thus, are subjected to large stresses. Heavy boom sections limit the reach, the height, and the lifting capacity of booms. An example of such a cantilever boom is shown in U.S. Pat. No. 2,684,159 of Oldenkamp.

Cable support systems have been developed for extending, retracting, and suspending extensible booms and these systems overcome some of the disadvantages associated with cantilever booms. Since the boom tip is supported by a suspension cable, a truss is formed by the cable, a cable support and the boom. This tends to eliminate internal bending stresses from the boom because the boom is a compression member within the truss. U.S. Pat. No. 2,819,803 of Obenchain shows an extensible boom that can be maintained at a substantially constant boom angle while the boom is extended or retracted. The boom tip is supported by pennant lines that are extended as the length of the boom increases and these lines are shortened as the boom is retracted. The pennant lines and the lines for extending and retracting the boom are compensating. A lock mechanism that includes a latch plate for engaging selected teeth in longitudinal rows is provided to retain the boom in any selected position of its extensible length for performing work. The lock mechanism is automatically released in response to control by a crane operator when it is desired to change the length of the boom.

Extensible booms, being supported at the boom tip by a suspension cable that is simultaneously compensating with an extension-retraction mechanism, are also shown in U.S. Pat. Nos. 3,029,954; 3,194,413; 3,308,967; 3,341,629; 3,426,917; 3,456,899; and 3,622,013. This type of boom suspension makes it difficult to extend the boom, particularly at a low boom angle near a horizontal position, because the load applied by the suspension cable to the tip of the boom places a force on the tip boom section that reacts axially of the boom against the boom extension mechanism.

U.S. Pat. No. 2,999,600 of Gates shows an extensible boom with a compensating cable suspension system supporting the boom at the boom tip and at the outer end of the lowermost boom section. A compensating cable suspension system supporting an extensible boom at the outer ends of each of four telescoping sections is shown in U.S. Pat. No. 3,534,867 of Johnston et al. Both of these systems apply loads to the outer ends of the movable sections and these loads tend to resist extension of the boom. Furthermore, since these booms are supported at their tips and at points intermediately of their length, undesirable bending stresses can develop within the boom sections near the points of intermediate support.

U.S. Pat. No. 3,845,866 of Eucken shows a telescopic crane jib with sections being fastened together by a locking bolt that is controlled by a fluid operated power cylinder. The jib sections are, extended and retracted in a vertical position by a fluid pressure operated cylinder. A catch mechanism holds an upper section to a lower section, while the fluid pressure operated cylinder is lowered, taking with it the other telescopic parts. In the lower positions, the lower end of the upper telescopic part can be locked to the upper end of the next telescopic part by a locking bolt that is controlled by the fluid operated power cylinder. The catch mechanism is released and the cylinder is raised, pushing the extended upper part of the housing until the upper end of the next part engages the catch mechanism.

Problems are encountered when pinning the sections of a crane boom together in positions other than vertical. In such positions, vertical bending moment is applied to the sections, causing some misalignment between the pins and the pin receiving holes. Due to such misalignment, it is possible that the pins will not be seated in the receiving holes. With this possibility, some crane operators want to set the pins while the boom is in a substantially horizontal position and then walk along each side of the boom to make certain that all pins are set before elevating the boom to a substantial height. Other crane operators, when using a boom with sections that have been pinned together in an upwardly inclined position, are satisfied if they can see from the ground that the pins are set.

SUMMARY OF THE INVENTION

An extensible boom is supported at a desired boom angle by a boom carrying rope, that is attached to the distal end of a fixed base section, and a movable section, that is supported as a cantilever from the base section, can be extended or retracted to a desired position, without having the cable apply a loading to the movable boom section. The boom sections are pinned together in the desired position at the control of a crane operator and pinning the sections together enables the boom to act as an integral unit for resisting compression axially of the boom and resisting bending transversely of the longitudinal axis of the boom in a generally vertical plane. After the boom has been pinned together at a desired length for operation, a boom pendant that was maintained in a slack condition during extension or retraction of the boom is tensioned to support the tip of the boom and the boom carrying rope is slackened.

In a preferred form of the invention, pin position indicators are provided to indicate to the crane operator whether or not the pins that lock the movable boom sections in place have been properly seated. A live mast is pivotally connected to the proximate end of the base section of the boom for supporting the boom pendant and the boom carrying rope in either an elevated operating position or a lowered traveling position. Mounted upon the live mast is a mechanism for alternately tensioning or slackening the boom carrying rope and this mechanism simultaneously slackens or tensions the boom pendant.

DESCRIPTION OF THE PREFERRED EMBODIMENT

Figure 1:
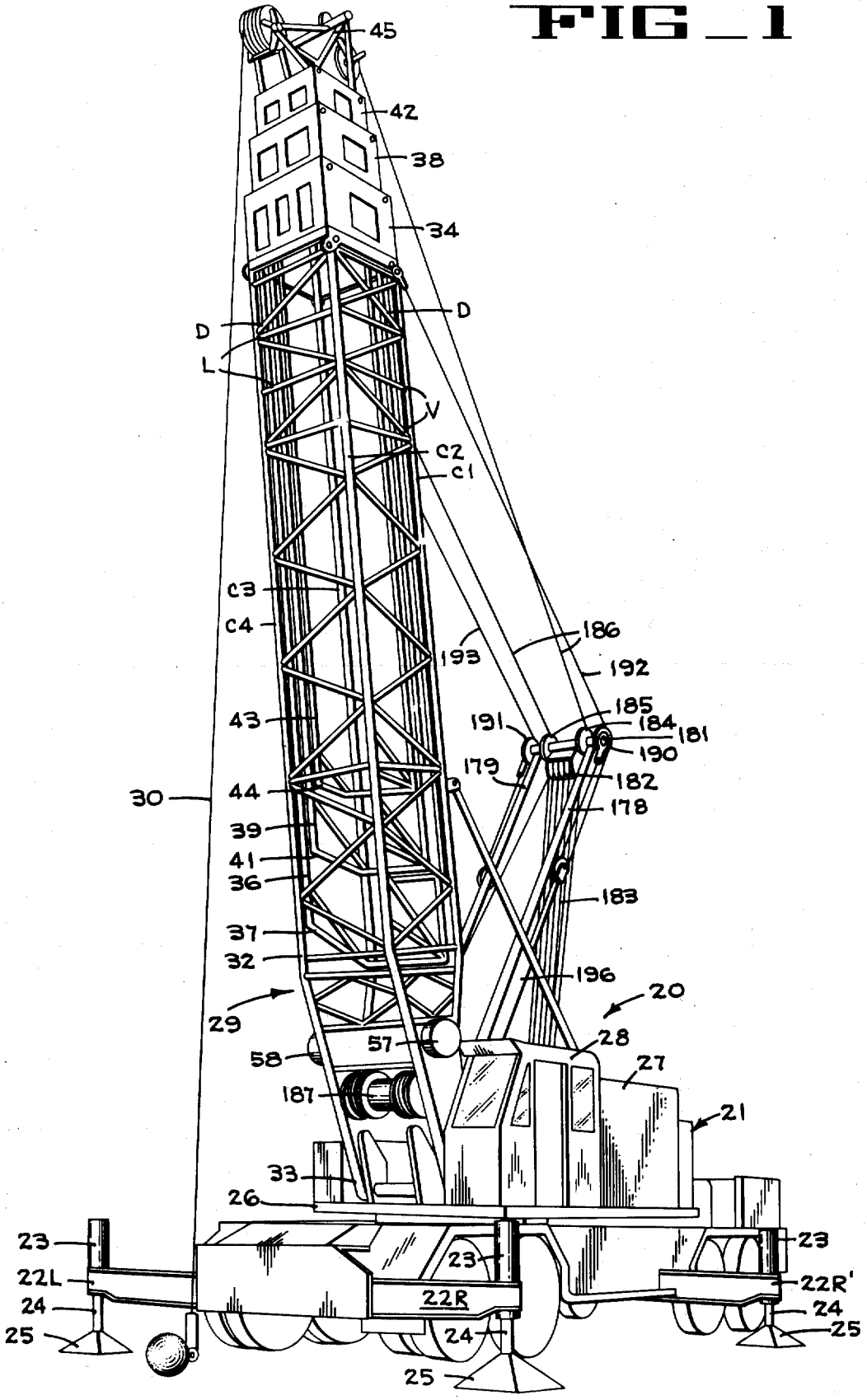
FIG. 1 is a perspective view of a crane having an extensible boom embodying the present invention.

With reference to FIG. 1, a crane 20 is mounted upon a truck type carrier 21. This carrier is stabilized in a working position by outrigger beams 22L and 22R that extend laterally outward from the left and the right sides, respectively, of the carrier at the rear end thereof, and by outrigger beams 22R' and another, not shown, that extend laterally outward from the right and left sides, respectively, of the carrier at a forward portion thereof. Each beam supports at its outermost end a hydraulic cylinder 23 and a piston rod 24 extends downwardly from the cylinder with a float 25 mounted at the lowermost end of the rod for engaging the ground. The crane has a machinery platform 26 that is mounted upon the carrier for pivotal movement in a substantially horizontal plane. This platform supports a crane power unit 27, a crane operator's cab 28, an extensible boom 29 over the tip of which a load line 30 is trained, and hoist machinery, not shown.

The extensible boom 29 has a fixed base section 32 and three movable sections 36, 39 and 43 that fit telescopically within the base section. The base section has a proximate end 33 that is pinned to the machinery platform 26 on a substantially horizontal axis and this section extends to a distal end 34 that can swing, in a substantially vertical plane, perpendicular to the platform. The rearward intermediate section 36 has a proximate end 37 that fits within the base section and a distal end 38 that extends outwardly from the distal end of the base section. The forward intermediate section 39 has a proximate end 41 that fits within the section 36 and a distal end 42 that extends outwardly from the distal end of section 36. The tip section 43 has a proximate end 44 that fits within the section 39 and a distal end 45 that extends outwardly from the distal end of section 39.

The boom sections 32, 36, 39 and 43 have a lattice box frame type of construction. The base section 32 has four longitudinal chord members C1, C2, C3, and C4 that are positioned in a transverse section as at the corners of a rectangle. The chord members C1 and C3 are upper chords and the chord members C2 and C4 are lower chords. These chord members are held in position by lateral bracing L, vertical bracing V and diagonal bracing D. It will be understood that sections 36, 39 and 43 have a similar lattice box frame type of construction.

Near the distal ends 34, 38 and 42 of sections 32, 36 and 39, respectively, are forward transitions having reinforcing plates on the four sides of the sections to carry the heavy loading that occurs at these joints as will be explained later.

Figure 2:
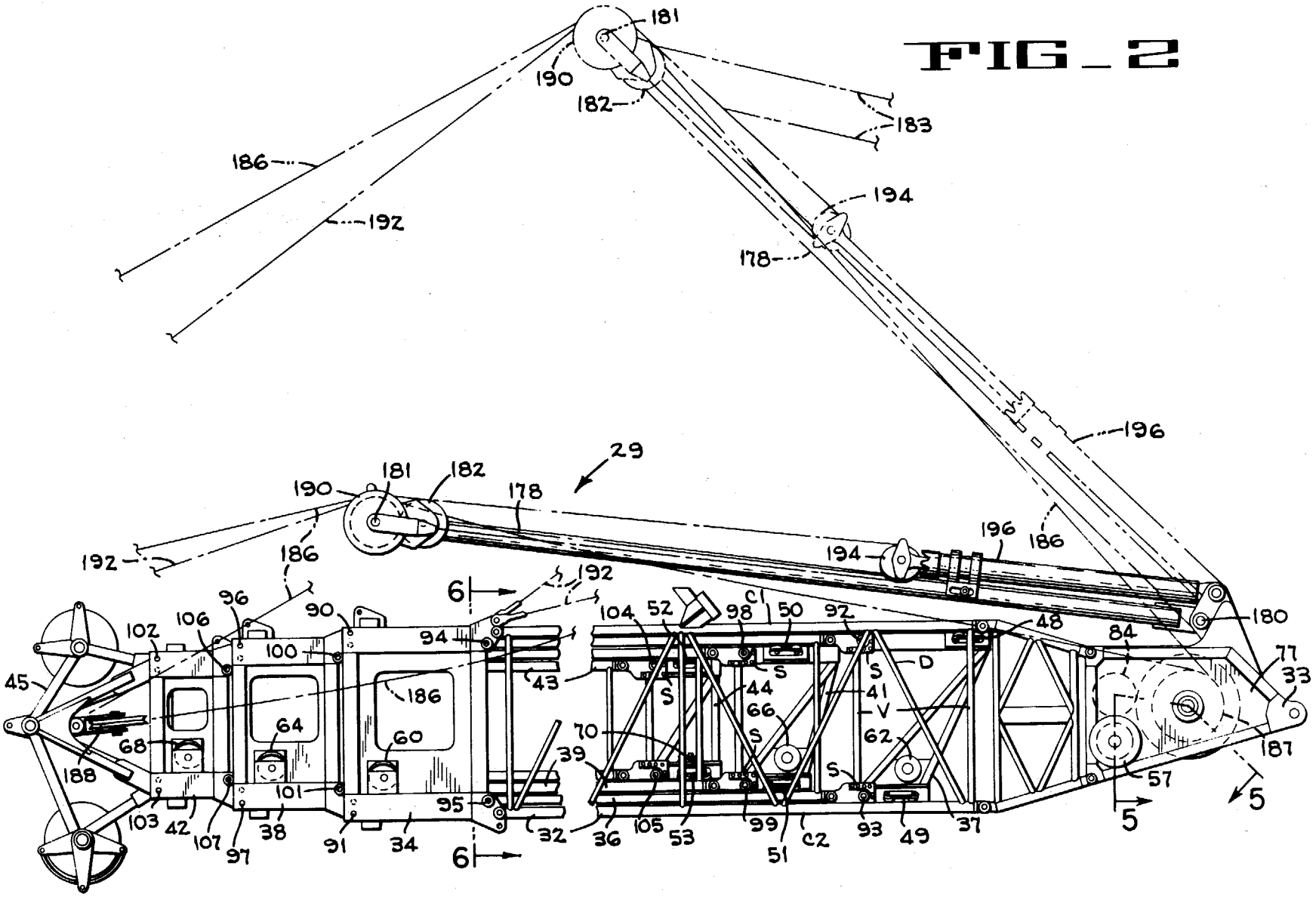
FIG. 2 is a broken side elevation view of the extensible boom shown in FIG. 1.

The sections 36, 39 and 43 are mounted for telescopic movement with minimal frictional resistance in the base section 32 and within each other. As shown in FIG. 2, the proximate end 37 of the rearward intermediate section 36 is supported to roll against upper chords C1 and C3 by roller assemblies 48 and upon lower chords C2 and C4 by roller assemblies 49. Similarly, the proximate end 41 of the forward intermediate section 39 is supported against the chords of the rearward intermediate section by upper roller assemblies 50 and lower roller assemblies 51. The proximate end 44 of the tip section 43 is supported by upper roller assemblies 52 and lower roller assemblies 53. It will be understood that conventional slidable shoe assemblies could be substituted for the roller assemblies. Within the forward transitions, at the distal ends of sections 32, 36 and 39, suitable slide shoe support or roller assemblies, not shown, are provided to support the sections 36, 39 and 43, respectively, for movement through the transitions.

Figure 4:
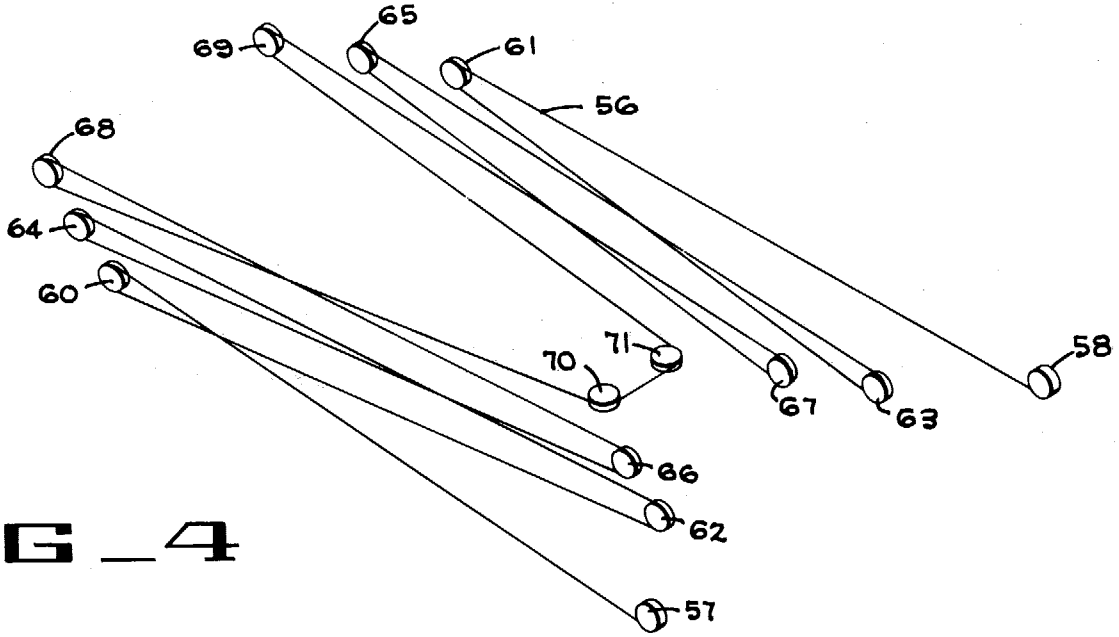
FIG. 4 is a diagrammatic view illustrating the reeving an an extender rope from two extender drums about sheaves on the boom sections.

Extension of the extensible boom 29 is controlled by an extender wire rope 56, shown in FIG. 4. One end of this rope is wound about an extender drum 57 that projects outwardly from one side of the boom and the opposite end of the rope is wound about an extender drum 58 that projects outwardly from the opposite side of the boom. A pair of sheaves 60 and 61 are mounted on opposite sides, at the distal end 34, of the base section 32 and a pair of sheaves 62 and 63 are mounted on opposite sides, at the proximate end 37, of the rearward intermediate section 36. A pair of sheaves 64 and 65 are mounted on opposite sides, at the distal end 38, of the rearward intermediate section 36. A pair of sheaves 66 and 67 are mounted on opposite sides, at the proximate end 41, of the forward intermediate section 39, and a pair of sheaves 68 and 69 are mounted on opposite sides, at the distal end 42, of section 39. A pair of sheaves 70 and 71 are mounted on opposite sides, at the proximate end 44, of the tip section 43. The intermediate portion of the rope 56 is trained about the sheaves in the order described above and extends horizontally between the sheaves 70 and 71. Thus, it will be seen that as the rope is wound upon the extender drums, the sections 36, 39 and 43 can be forced outwardly from the base section 32.

Figure 5:
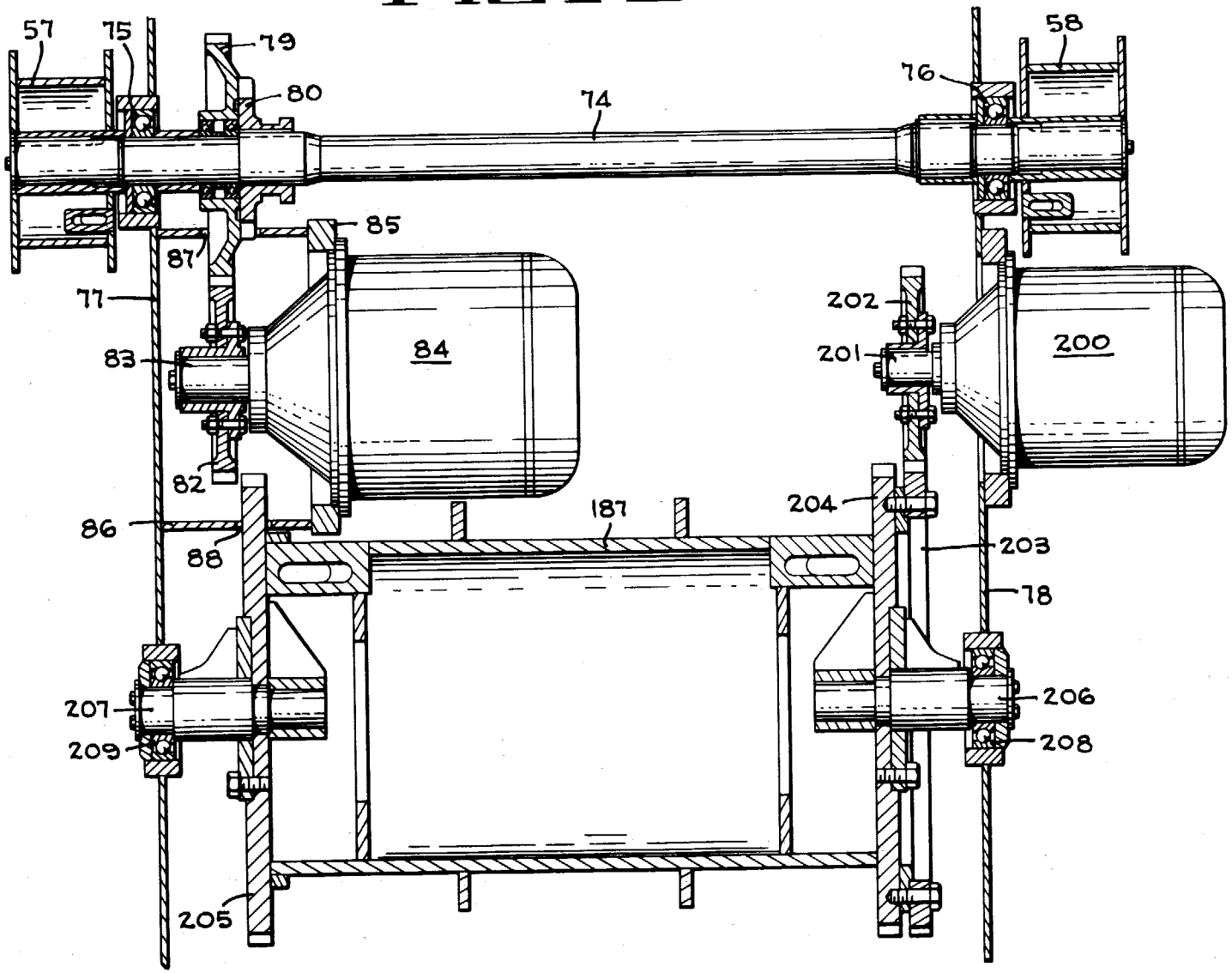
FIG. 5 is an enlarged transverse boom section taken on the line 5—5 of FIG. 2.

The extender drums 57 and 58 are driven by machinery located near the proximate end 33 of the base section 32. With reference to FIG. 5, each extender drum is splined to an end of a shaft 74 that extends laterally of the base section. This shaft is journalled within conventional bearing assemblies 75 and 76 that are mounted within side plates 77 and 78, respectively, on opposite sides of the base section. A spur gear 79 is rotatably mounted upon the shaft and this gear is locked in place for rotation with the shaft by a locking hub 80 that is splined to the shaft. The spur gear 79 meshes with a spur gear 82 that is mounted upon an output shaft 83 of a hydraulic motor 84. The hydraulic motor is held in place by a mounting ring 85 that is supported by a sleeve 86 projecting inwardly from the side plate 77. This sleeve has slotted openings 87 and 88 therein for receiving a segmental portion of the spur gear 79 and for receiving a portion of a ratchet wheel 205 that will later be described. The extender drums are driven by the hydraulic motor, through the spur gears 79 and 82 and the shaft 74.

The boom sections 36, 39 and 43 are locked in a desired position by hydraulically controlled pins. With reference to FIG. 2, pins 90 and 91 are provided at the top and bottom, respectively, near the distal end 34 of the base section 32, to lock the rearward intermediate section 36, in a retracted position within the base section. Pins 92 and 93 are provided at the top and bottom, respectively, near the proximate end 37, of the section 36, to lock this section in an extended position when these pins are aligned with pin connecting hub openings 94 and 95 at the top and bottom, respectively, in the base section. Such alignment is made when the stop blocks S adjacent the pins 92 and 93 contact the pin connecting hubs that define the openings 94 and 95. Pins 96 and 97 are provided at the top and bottom, respectively, near the distal end 38 of the section 36 to lock the forward intermediate section 39 in a retracted position within the section 36. Pins 98 and 99 are provided at the top and bottom, respectively, near the proximate end 41, of section 39, to lock this section in an extended position, when these pins are aligned opposite the pin connecting hub openings 100 and 101 at the top and bottom, respectively, in the section 36. Pins 102 and 103 are provided at the top and bottom, respectively, near the distal end 42, of the section 39, to lock the tip section 43 in a retracted position within the section 39. Pins 104 and 105 are provided at the top and bottom, respectively, near the proximate end 44, of section 43, to lock this section in an extended position when these pins are aligned opposite the pin connecting hub openings 106 and 107 at the top and bottom, respectively, in the section 39.

Figure 6:
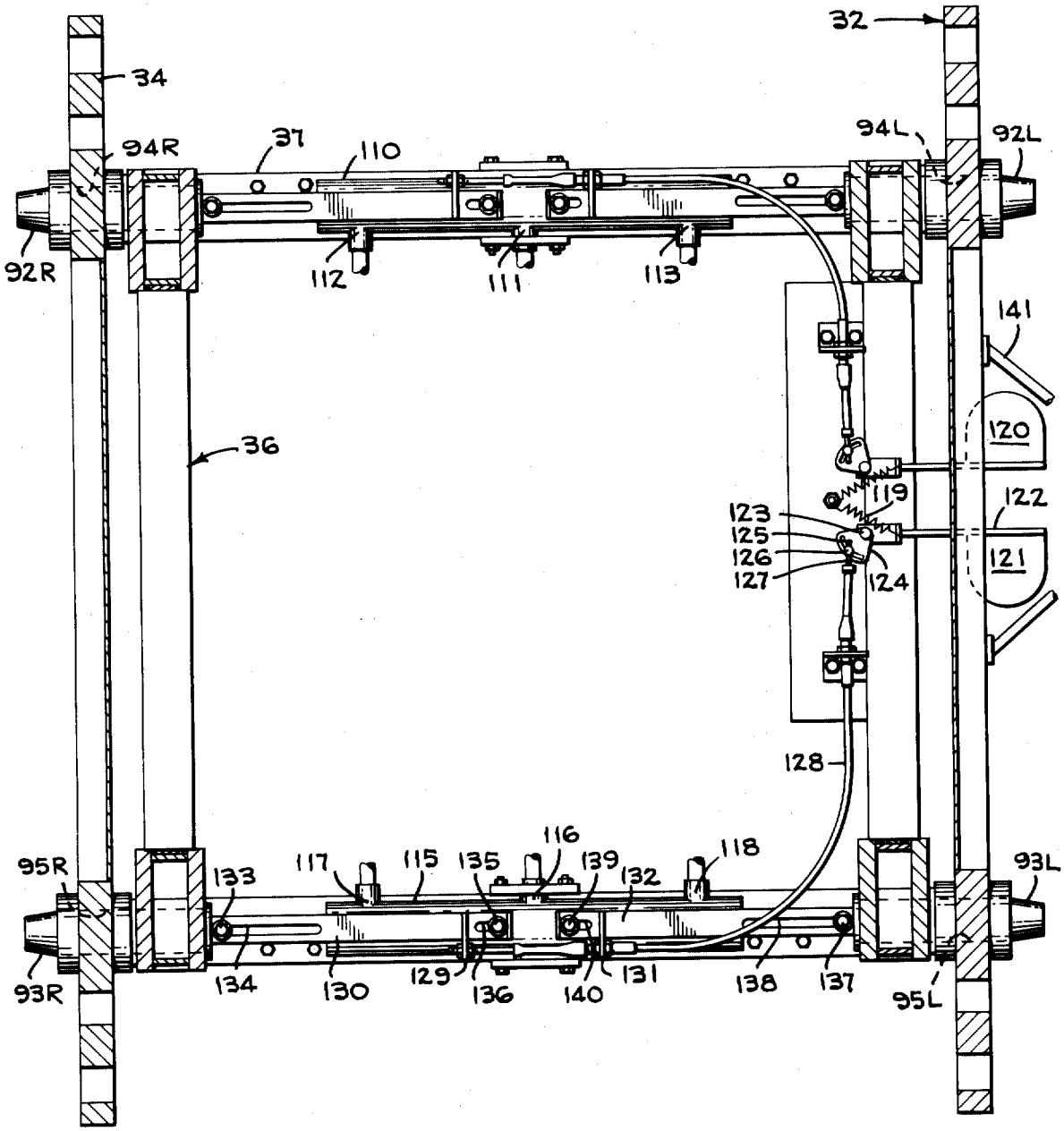
FIG. 6 is an enlarged transverse section taken with the boom in a fully extended position at a location corresponding to the line 6—6 of FIG. 2 and illustrating the pins and pin position indicators at the proximate end of a boom section in a seated position at the distal end of an adjacent boom section.

With reference to FIG. 6, a typical set of pins 92L, 92R, 93L and 93R at the proximate end 37 of a boom section 36, is shown seating within pin connecting hub openings 94L, 94R, 95L, and 95R at the distal end 34 of an adjacent outer boom section 32. The pins 92L and 92R are located at the ends of piston rods that project from opposite ends of a hydraulic cylinder 110. This cylinder is provided with one extend port 111 that is located in the middle of the cylinder and with two retract ports 112 and 113 that are located at opposite ends of the cylinder. Similarly, the pins 93L and 93R, that fit within the pin connecting hub openings 95L and 95R, are mounted on piston rods projecting from opposite ends of a hydraulic cylinder 115. This cylinder is provided with an extend port 116 and with two retract ports 117 and 118. When pressure is applied to the extend port, pins 92L and 92R are forced outwardly from the cylinder 110 to seat within the pin connecting hub openings 94L and 94R in the base section 32 and pins 93L and 93R are forced outwardly from the cylinder 115 to seat within the pin connecting hub openings 95L and 95R. Thus, the proximate end of the rearward intermediate section 36 is locked to the distal end 34 of the base section 32. When pressure is applied to the retract ports, the pins are withdrawn from the pin connecting hub openings so that section 36 can move rearwardly relative to the base section.

A pin position indicator flag 120 is provided to show, to the crane operator, whether or not the pins 92R and 92L are seated, in a locking position. Likewise, a flag 121 indicates whether or not the pins 93R and 93L are seated. Only the mechanism for operating the flag 121 will be described in detail. The flag 121 is mounted upon an arm 122 that is fixed to pivot shaft 123. This shaft is pivotally mounted on the boom section 36 and a cam 124 is fixed to the shaft for rotating the arm. A spring 119 connects the arm 122 to the boom section 36 to pull the arm over center when the pins are nearly set or unset. An arcuate slot 125 is provided within the cam and a cam mover 126, that is slidably fitted within the slot, is coupled to the cam. This cam mover is also connected to one end of a flexible control cable 127 that is slidable axially within a cable housing 128. The opposite end of the control cable is coupled by a connector 129 to a slotted link 130, while the end of the cable housing, that is adjacent this end of the cable, is coupled by a slidable connector 131 to a slotted link 132. The link 130 is coupled by a bolt 133 to a connector on the pin 93R, that is actuated by the piston rod projecting from the hydraulic cylinder 115. An elongated slot 134, within the link and through which the bolt fits, provides for a certain amount of lost motion before the link moves with the bolt. A bolt 135 fits through an elongated slot 136 to couple the link 130 to the hydraulic cylinder 115, and this slot provides for a certain amount of link movement. A bolt 137 fits through an elongated slot 138 in the link 132, to couple this link to a connector on the pin 93L, that is actuated by the piston rod projecting from the hydraulic cylinder 115. A bolt 139 fits through an elongated slot 140 in the same link, to couple the link to the hydraulic cylinder 115.

Figure 7:
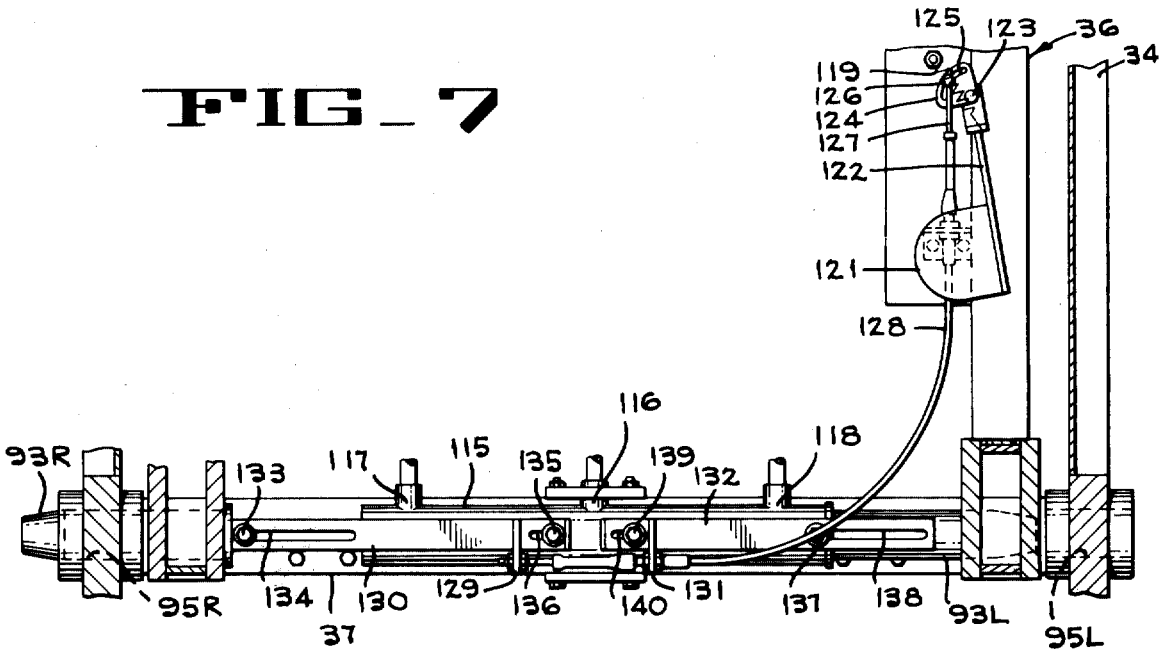
FIG. 7 is a fragmentary view of the section shown in FIG. 6 illustrating the pins and pin position indicators in a partial seated pin position.
Figure 8:
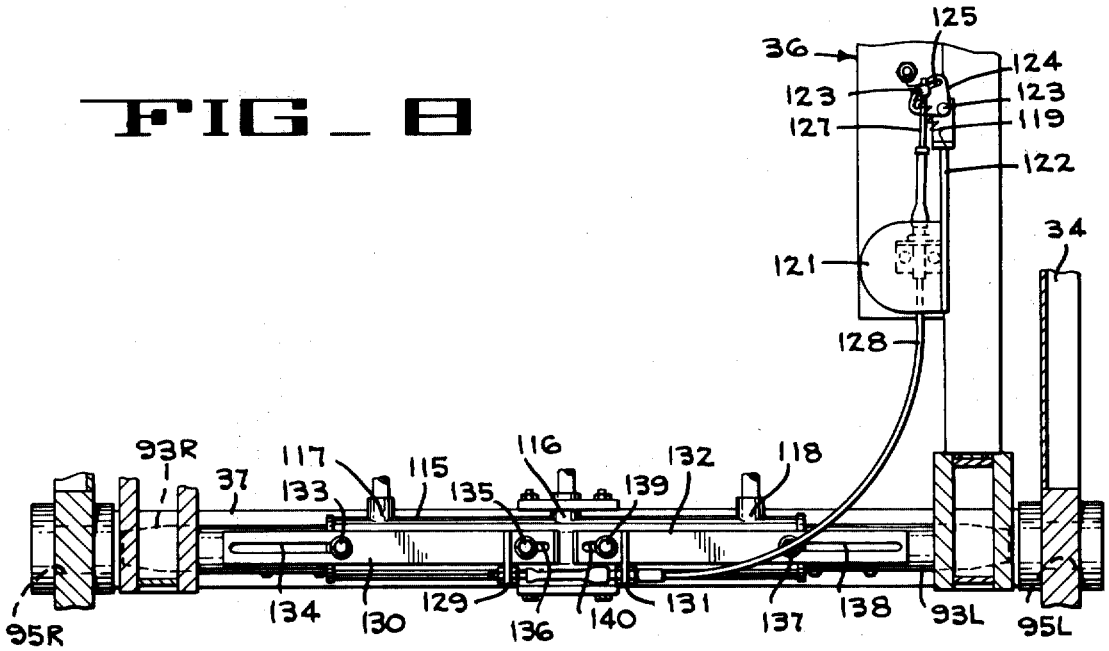
FIG. 8 is a fragmentary view of the section shown in FIG. 6 illustrating the pins and pin position indicators in an unseated pin position.
Figure 9:
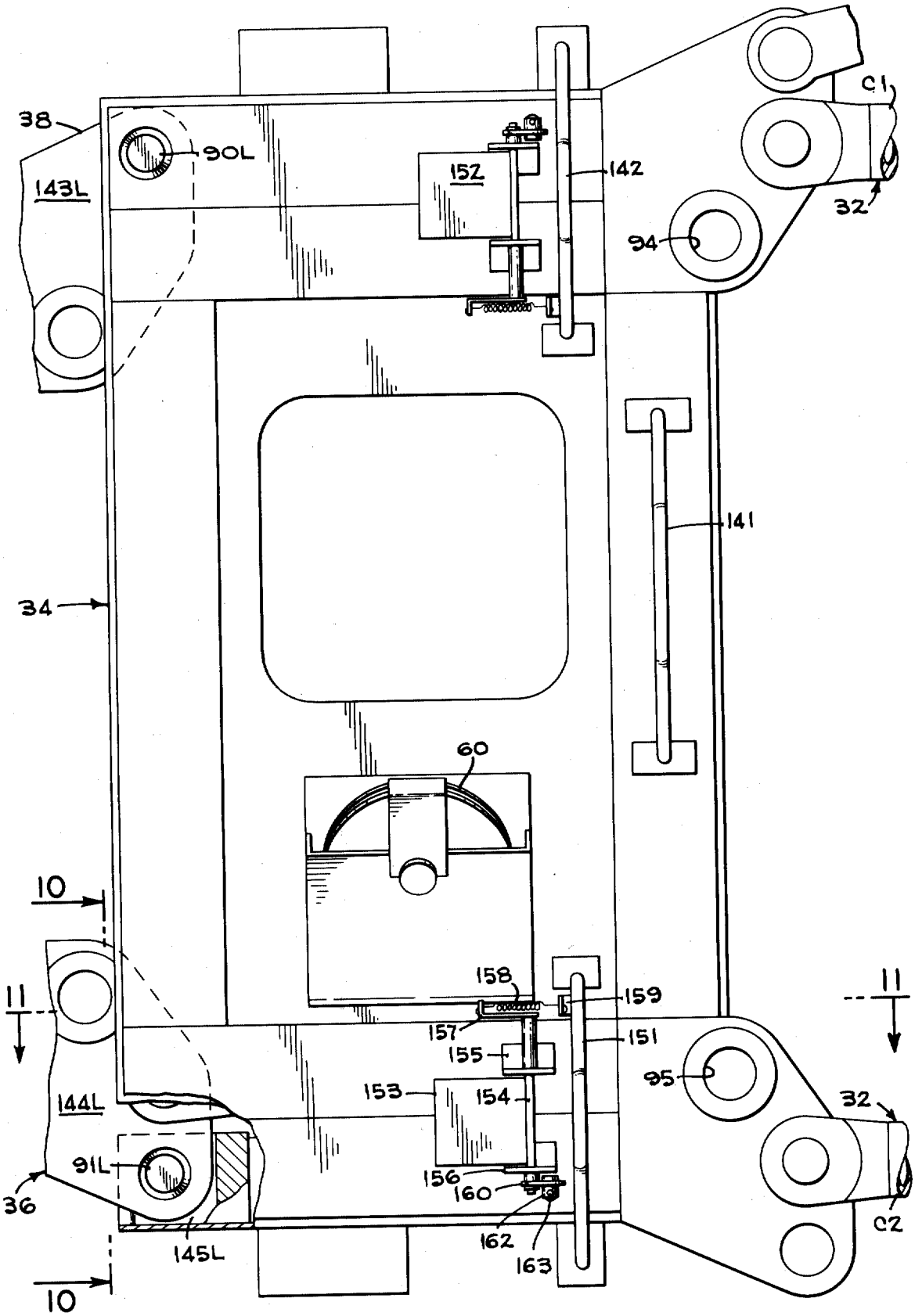
FIG. 9 is an enlarged side elevation of a forward transition fragment of a boom section illustrating the pins and pin position indicators.

When both pins 93R and 93L are extended, to be seated as shown in FIG. 6, the cable 127 is pulled downwardly to elevate the flag 121, as shown. A guard 141 is mounted on the base section 32, as shown in FIGS. 6 and 9, to protect the flag 121. In the event that one pin was extended and seated, while the other pin was not, due to misalignment of the pin and the pin connecting hub opening, the flag 121 is only partially extended, as shown in FIG. 7. While the end of the cable 127, that is coupled to the link 130, remains in the same position, as shown in FIG. 6, the end of the housing 128, that is coupled by the connector 131 to the link 132, is moved towards that end of the cable. Thus, the opposite end of the cable, that is coupled to the cam 124, is extended upwardly from the housing, the cam mover 126, acting upon the cam, causes the arm 122 to pivot downwardly. When both pins are retracted, as shown in FIG. 8, the link 130 is moved towards the connector 131, forcing the end of the cable 127, that is coupled by the connector 131 to the link 132, into the end of the housing 128. The opposite end of the cable, that is coupled to the cam 124, is further extended upwardly and the cam mover, acting upon the cam, causes the flag to pivot downwardly to a retracted position.

Figure 10:
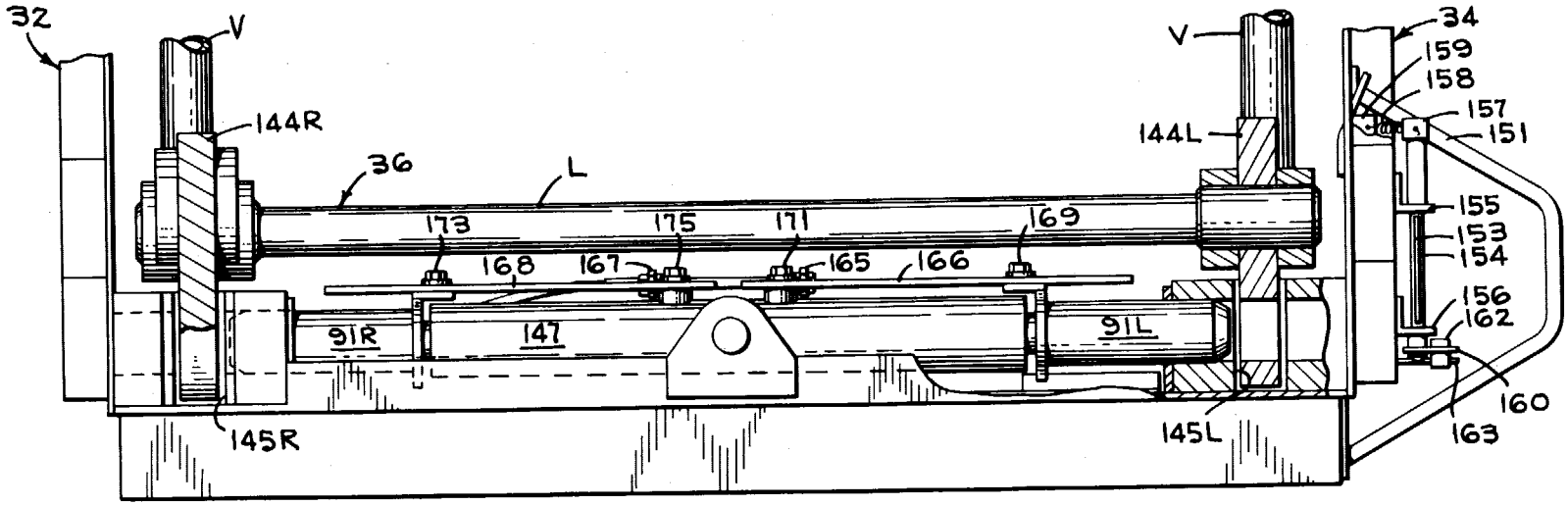
FIG. 10 is a section taken on the line 10—10 of FIG. 9.
Figure 11:
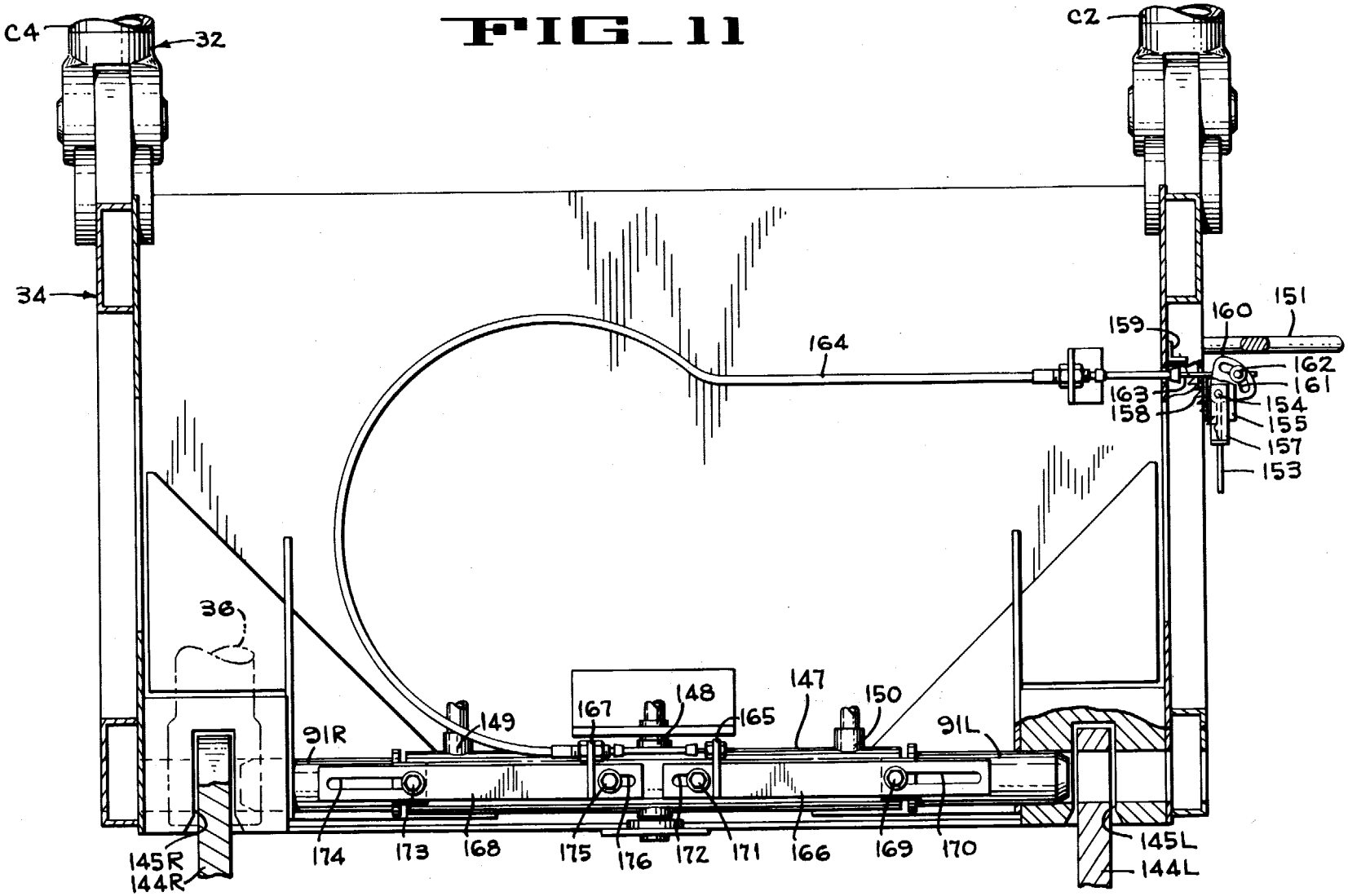
FIG. 11 is a section taken on the line 11—11 of FIG. 9.

FIGS. 9–11 illustrate the typical pinning arrangement, at the distal ends of the boom sections 32, 36 and 39. The forward transition portion of the boom section 36 is shown in a retracted position within the forward transition portion of the adjacent outer boom section 32. Coupling flanges 143 project upward from each side, at the top of the rearward intermediate section 36, and these flanges are coupled, to the base section 32, by the pins 90. Similarly, coupling flanges 144L and 144R, shown in FIG. 10, project downwardly from the bottom of section 36, at the left and right sides thereof, respectively. These flanges fit within slots 145L and 145R in the base section and the flanges are coupled to the base section by the pins 91L and 91R, respectively.

The pins 91L and 91R are located at the ends of the piston rods that project from opposite ends of a hydraulic cylinder 147. This cylinder is provided with one extend port 148 at the midportion of the cylinder and two retract ports 149 and 150 are provided near the ends of the cylinder. When pressure is applied to the extend port, both pins are forced outwardly from the cylinder, through openings in the flanges 144L and 144R, to lock the rearward intermediate section 36 in a retracted position within the base section 32. When pressure is applied to the retract ports, the pins are withdrawn, and section 36 can be moved forward to an extended position. It will be understood that a hydraulic cylinder, similar to cylinder 147, is provided to actuate the pins 90 at the top of the base section.

A pair of pin position indicator flags 152 and 153 are mounted on the left side of the forward transition portion of the base section 32, near the top and bottom portions thereof. The flag 152 indicates the position of the pins 90 and the flag 153 indicates the position of the pins 91. A guard 142 is mounted near the top of the base section for protecting the flag 152 and a guard 151 is mounted near the bottom of the base section for protecting the flag 153. The mechanism for operating the flag 152 is similar to the mechanism that will now be described for operating flag 153. This flag is mounted upon a shaft 154 that is rotatably supported from the base section by an upper bracket 155 and by a lower bracket 156. A spring lever 157 is mounted at the upper end of the shaft, to rotate therewith, and a tension spring 158 is connected between the spring lever and a spring bracket 159, that is mounted on the base section. The spring pulls the flag over center when the pins are nearly set or unset. A cam 160 is mounted at the lower end of the shaft for rotating the shaft. This cam has an arcuate slot 161 within which a cam mover 162 is slidably fitted for connecting one end of a flexible control cable 163 to the cam. This control cable is slidable axially within a cable housing 164, that is mounted to the base section 32 near the cam. The opposite end of the cable is coupled by a slidable connector 165 to a slotted link 166, while the end of the cable housing, that is located near this end of the cable, is coupled by a slidable connector 167 to a slotted link 168. The link 166 is coupled by a bolt 169, that projects through an elongated slot 170 in the link, to a connector on the pin 91L, that is actuated by the piston rod projecting from the hydraulic cylinder 147. A bolt 171 fits through an elongated slot 172, in the link 166, to couple the link to the hydraulic cylinder 147. The link 168 is coupled by a bolt 173, that projects through an elongated slot 174 in the link, to a connector on the pin 91R, that is actuated by the piston rod projecting from the hydraulic cylinder 147. A bolt 175 fits through an elongated slot 176, in the link 168, to couple the link to the hydraulic cylinder 147.

When both pins 91R and 91L are retracted, as shown in FIGS. 9–11, the cable 163 forces the cam mover 162 to position the cam 160 so that the flag 153 extends parallel to the side of the base section 32. In the event that one pin is extended and seated, while the other pin is retracted and cannot seat because of misalignment of either the flange 144R or the flange 144L, the cable will be drawn to pivot the cam and rotate the shaft 154 to cause the flag 153 to move outwardly at approximately a ten degree angle to the side of the base section. When both pins are seated, the cable is drawn further inward towards the housing and the cam 160 is pivoted so that the shaft 154 is rotated to where the flag 153 projects outwardly perpendicular to the side of the base section.

Figure 3:
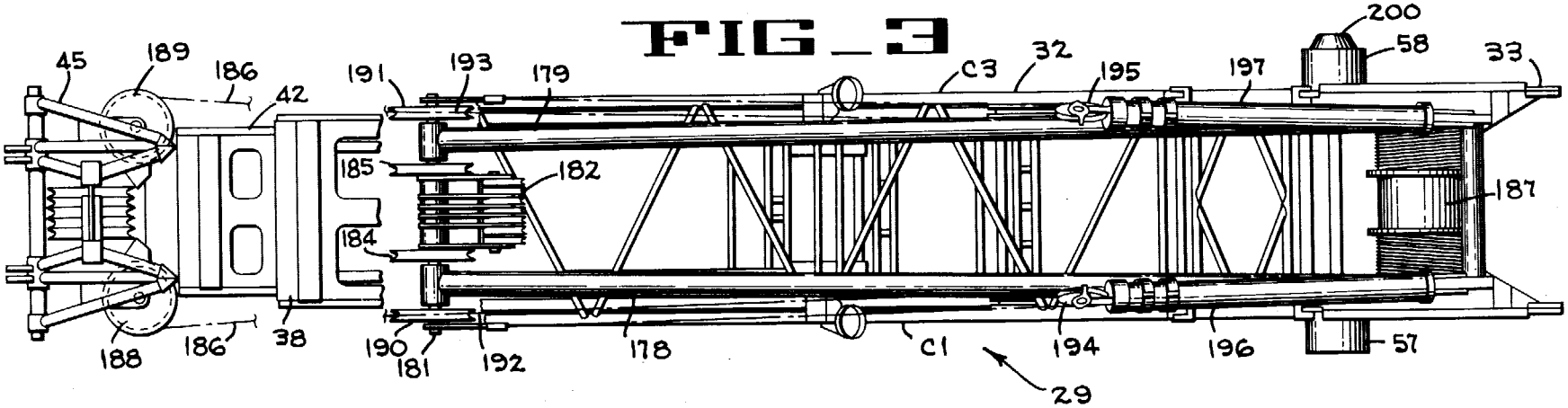
FIG. 3 is a plan view of the boom shown in FIG. 2.

It is desirable at various times to provide support for the distal ends of the base section 32 and the tip section 43, so that these sections of the extensible boom 29 do not have to carry loading as cantilever spans. A pair of live masts 178 and 179 (FIGS. 1 and 3) are pivotally attached to the base section 32 near its proximate end 33 by foot pins 180, as shown in FIG. 2. A head shaft 181 (FIG. 3) extends transversely between the live masts at their ends opposite from the foot pins. A multiple sheave block 182, for receiving a boom hoist wire rope 183, is mounted near the mid-point of the head shaft. Spaced outwardly on the head shaft from the block are a pair of sheaves 184 and 185, that provide support for a boom pendant 186. This boom pendant extends from a storage drum 187, at the proximate end 33 of the base section, over the sheave 184, to a pair of sheaves 188 and 189, that are located at the distal end 45 of the tip section 43, and then returns over the sheave 185, to the storage drum. A sheave 190 is mounted on the head shaft end projecting outwardly from the live mast 178 and a sheave 191 is mounted on the opposite end of the head shaft. A boom carrying rope 192 is trained over the sheave 190 and a boom carrying rope 193 is trained over the sheave 191. These boom carrying ropes are connected to the base section, near the distal end thereof. The boom carrying rope 192 extends over a sheave 194 and the boom carrying rope 193 extends over a sheave 195, and these boom carrying ropes are connected to the head shaft 181. The sheave 194 is mounted at the end of an actuating arm, projecting from a hydraulic cylinder 196, that is coupled to the live mast 178. The sheave 195 is mounted at the end of an actuating arm, projecting from a hydraulic cylinder 197, that is coupled to the live mast 179. Slack can be provided or taken up, in the boom carrying ropes, by extending or retracting the actuating arms of the hydraulic cylinders 196 and 197.

The pendant storage drum 187, shown in FIG. 5, is driven by a hydraulic motor 200, that is mounted on the side plate 78. This motor has an output shaft 201 with a spur gear 202 mounted thereon, and this spur gear meshes with a ring gear 203, that is bolted to a ratchet wheel 204, at one end of the drum. The ratchet wheel 205 is fixed to the opposite end of the drum, from the ratchet wheel 204, and a segmental portion thereof fits through the slotted opening 88, in the sleeve 86. The drum is supported for rotation by stub shafts 206 and 207, that are bolted to the ratchet wheels and project axially of the drum into bearing assemblies 208 and 209, respectively. The bearing assembly 208 is mounted in the side plate 78, and the bearing assembly 209 is mounted in the side plate 77. Thus, it will be seen that the hydraulic motor drives the spur gear, which in turn rotates the ring gear and the pendant storage drum. Pawls, not shown, are operated to engage the ratchet wheels by a push-pull cable at the control of the crane operator, to lock the drum in a desired position.

Figure 12:
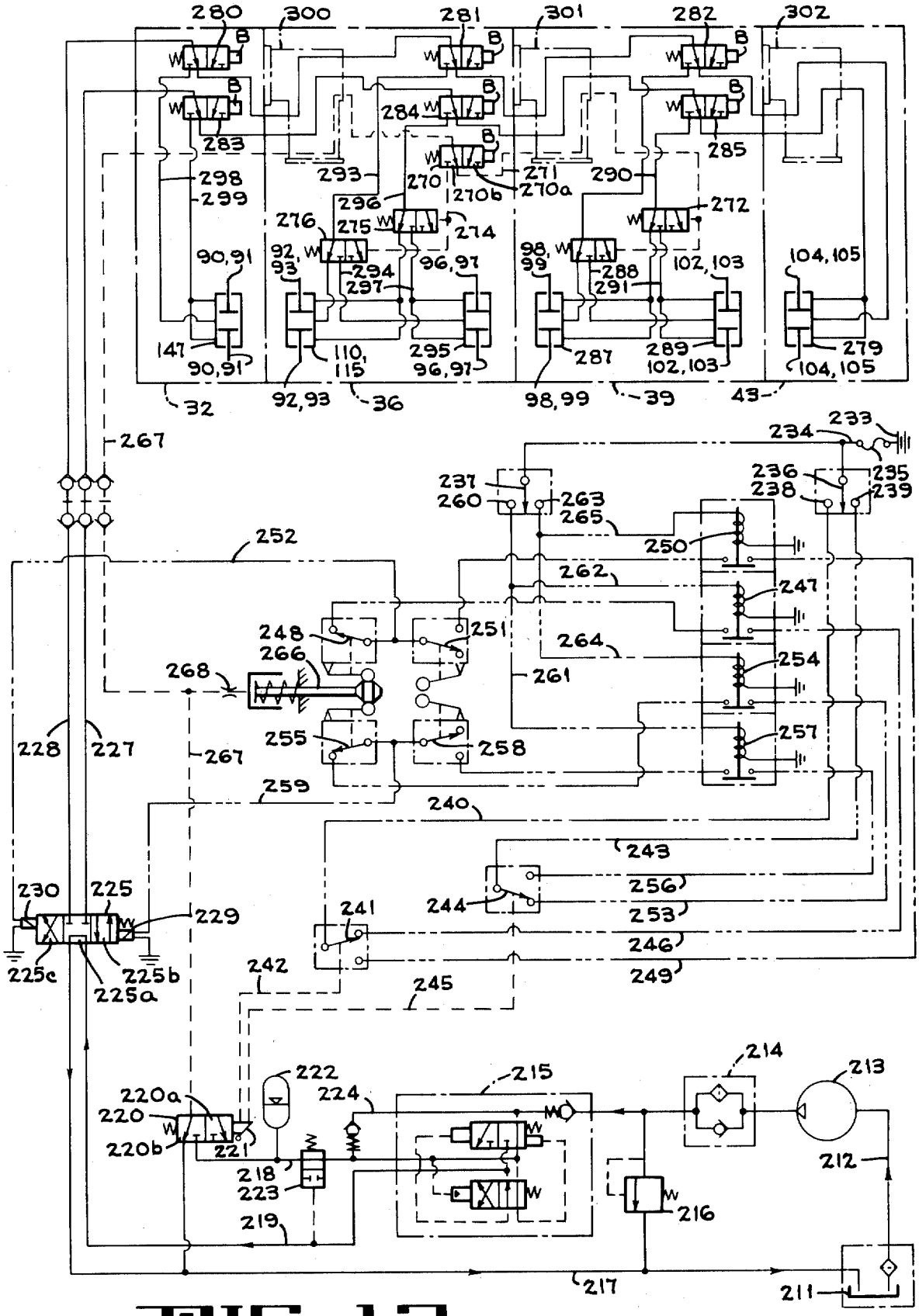
FIG. 12 is a diagrammatic view illustrating the hydraulic and electrical circuitry for controlling the pins that interlock the boom sections.

With reference to FIG. 12, the control circuit for pinning and unpinning the boom sections 36, 39 and 43 is shown. Hydraulic fluid is drawn from a sump tank 211, through a line 212, by a pump 213, and forced through a filter 214, to an unloading valve 215. A pressure relief valve 216 is connected between the line 212, on the discharge side of the filter, and a flow return line 217, that is connected to the sump tank. The unloading valve is pilot operated to control the flow to a pin selector supply line 218 and to a pin actuating supply line 219. The pin selector supply line couples the unloading valve with a pin cylinder selector valve 220 that is a directional valve having a position **220*a* for activating the pin cylinders at the distal ends of the boom sections and a position 220*b* for activating the pin cylinders at the proximate ends of the boom sections. The pin selector valve is controlled by a pin cylinder selector lever 221 that is located in the operator's cab 28. an accumulator 222 is provided in the line 218 as is a shut off valve 223 that is controlled by hydraulic pressure in line 219. A valve by-pass line 224 that extends from the line 212 about the valve 215 is connected to the line 218. The line 219 is connected to a pin actuating supply valve 225 as is the return line 217** that connects this valve to the sump tank.

The pin actuating supply valve 225 is a directional valve having an intermediate position **225*a* that blocks flow on the discharge side of the valve and is arranged to divert flow on the inlet side from the pin actuating supply line 219 to the flow return line 217. This valve has a retract position 225*b* that feeds a boom pin retract line 227 and an extend position 225*c* that feeds a boom pin extend line 228. The positioning of this valve is controlled by a retract solenoid 229 and by an extend solenoid 230**. These solenoids are controlled by an electrical circuit that will now be described.

A battery 233 is connected by a line 234 with a fuse 235 therein to a pin function or pin control switch 236 and to a pin sequence or interlock switch 237. These switches are located in the operator's cab 28 and they are controlled by the operator. The switch 236 has a pin extend contact 238 and a pin retact contact 239. A line 240 connects the pin extend contact with a delay switch 241 that is operated by a mechanical linkage 242 from the pin cylinder selector lever 221. A line 243 connects the pin retract contact with a delay switch 244 that is operated by a mechanical linkage 245 from the pin cylinder selector lever. The delay switch 241 is connected by a line 246 through a relay 247 to a rear extend delay switch 248 and by a line 249 through a relay 250 to a forward extend delay switch 251. A line 252 connects the switches 248 and 250 to the extend solenoid 230. The delay switch 244 is connected by a line 253 through a relay 254 to a rear retract delay switch 255 and by a line 256 through a relay 257 to a forward extend delay switch 258. The switches 255 and 258 are connected by a line 259 to the retract solenoid 229. The switch 237 has a boom extend contact 260 that is connected by a line 261 to a coil that controls the relay 257 and to a line 262 with a coil that controls the relay 247. The switch 237 has a boom retract contact 263 that is connected by a line 264 to a coil that controls the relay 254 and to a line 265 with a coil that controls the relay 250. The delay switches 248, 251, 255 and 258 are controlled by a spring return plunger 266 that is hydraulically actuated by pressure in a pilot line 267 extending from the pin cylinder selector valve 220. An orifice 268, that is located between the pilot line 267 and a hydraulic cylinder housing the plunger, causes a time delay in operation of the delay switches. This time delay enables hydraulic pressure changes in the pilot line to reach pinning cylinder selector valves at the outermost ends of the pilot line before actuation of the pin actuating supply valve 225.

The pilot line 267 that extends from the pin cylinder selector valve 220 is connected to a boom section selector valve 270 that is a directional valve having a position **270*a* for activating pin cylinders in the boom section 36 and a position 270*b* for activating pin cylinders in the boom section 39. The positoining of this valve is controlled by a bumper B that is engaged upon retraction of the boom section 39 and by a spring to return the valve when the boom section is extended. A pilot line 271 extends from the valve 270 to a pair of pinning cylinder selector valves 272 and 273, and a pilot line 274 extends from the valve to a pair of pinning cylinder selector valves 275 and 276. The boom pin extend line 228 is connected to a directional valve 280 in the base section 32, a directional valve 281 in the rearward intermediate section 36, a directional valve 282 in the forward intermediate section 39, and to hydraulic cylinders 279 for extending the pins 104 and 105 at the proximate end of the tip section 43. The boom pin retract line 227 is connected to a directional valve 283 in the base section 32, a directional valve 284 in the rearward intermediate section 36, a directional valve 285 in the forward intermediate section, and to the hydraulic cylinders 279 for retracting the pins 104 and 105**.

The directional valves 280 –285 are controlled by bumpers B that are engaged upon retraction of the preceeding boom section to shift the directional valves to positions diverting hydraulic pressure to pinning cylinders within the same boom section as the directional valve. Springs return these valves to their original positions when the preceeding boom sections are extended. When valve 282 is shifted upon retraction of the tip section 43, hydraulic pressure from the boom pin extend line 228 is applied to a line 286, that passes through the pinning cylinder selector valve 273 to hydraulic cylinders 287, for extending the pins 98 and 99. When the valve 273 is shifted by pressure in the pilot line 271, hydraulic pressure is applied from the valve, through a line 288, to hydraulic cylinders 289 for extending the pins 102 and 103. When the valve 285 is shifted by retraction of the tip section 43, hydraulic pressure from the boom pin retract line 227 is applied through a line 290 and through the valve 272 to hydraulic cylinders 287 for retracting the pins 98 and 99. When the valve 272 is shifted by pressure in the pilot line, pressure is applied from the valve, through a line 291, to hydraulic cylinders 289, for retracting pins 102 and 103.

When valve 281 is shifted upon retraction of the forward intermediate section 39, hydraulic pressure from the boom pin extend line 228 is applied to a line 293, that passes through the pinning cylinder selector valve 276, to hydraulic cylinders 110 and 115, for extending pins 92 and 93. When the valve 276 is shifted by pressure in the pilot line 274, hydraulic pressure is applied from the valve, through a line 294, to hydraulic cylinders 295, for extending pins 96 and 97. When valve 284 is shifted by retraction of the forward intermediate section 39, hydraulic pressure, from the boom pin retract line 227, is applied, through a line 296 and the valve 275, to hydraulic cylinders 110 and 115, for retracting the pins 92 and 93. When the valve 275 is shifted by pressure in the pilot line 274, pressure is applied from the valve, through a line 297, to hydraulic cylinders 295 for retracting the pins 96 and 97.

When valve 280 is shifted upon retraction of the rearward intermediate section 36, hydraulic pressure, from the boom pin extend line 228, is applied to a line 298, that is connected to hydraulic cylinders 147, for extending the pins 90 and 91. When valve 283 is shifted by retraction of the section 36, hydraulic pressure, from the boom pin retract line 227, is applied to a line 299, that is connected to hydraulic cylinders 147, for retracting the pins 90 and 91. To provide for handling the line 227, the line 228 and the pilot line 267, during extension and retraction of the extensible boom 29, a reel 300 is mounted in the section 36, a reel 301 is mounted in the section 39, and a reel 302 is mounted in the tip section 43.

Figure 13:
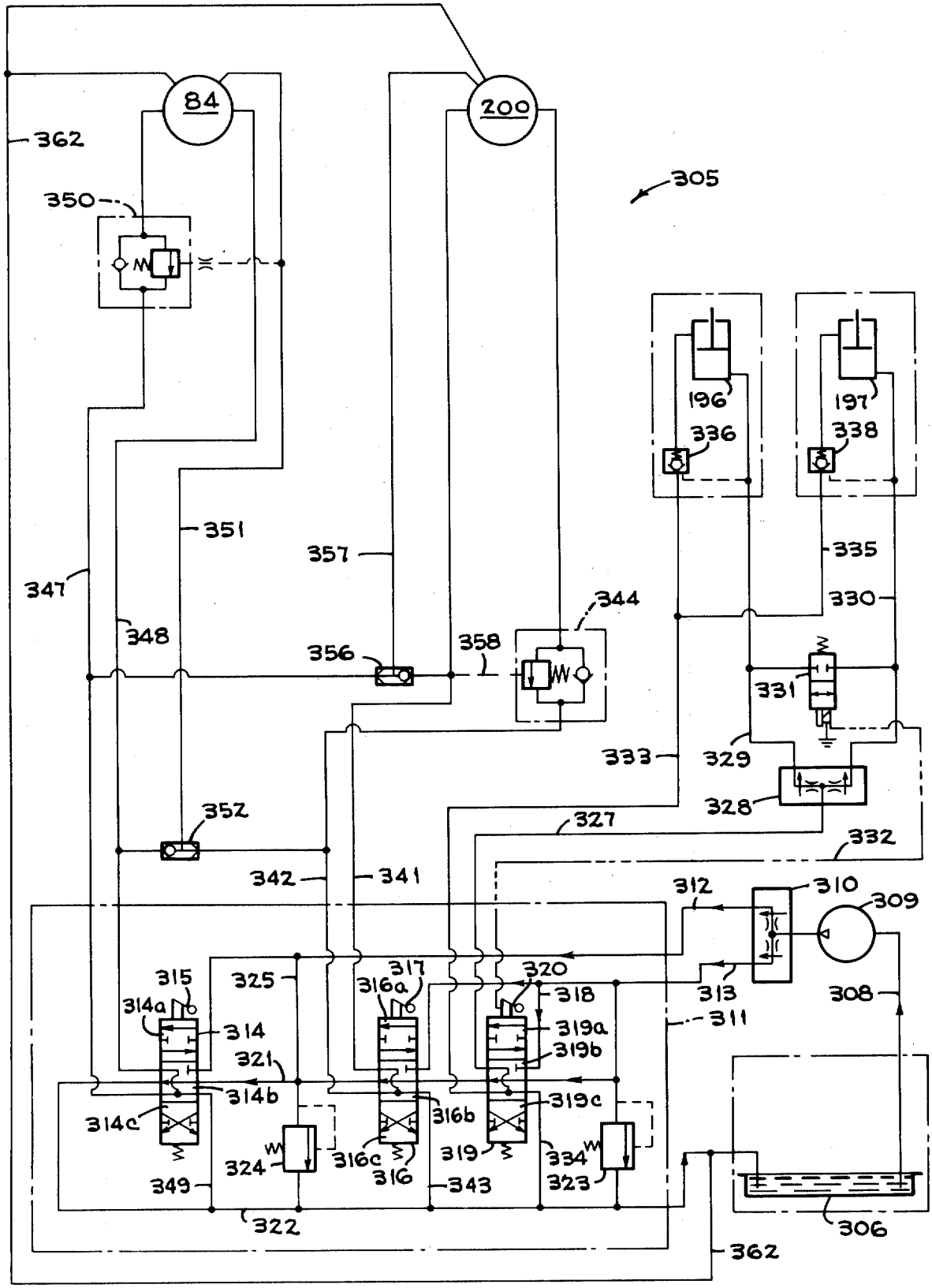
FIG. 13 is a diagrammatic view illustrating the hydraulic and electrical circuitry for controlling the hydraulic motors and the hydraulic cylinders that regulate extension, retraction and support of the boom sections.

Looking now at FIG. 13, a hydraulic control circuit 305 is shown for actuating the extender drum hydraulic motor 84, the boom pendant storage drum hydraulic motor 200, and the live mast hydraulic cylinders 196 and 197. Hydraulic fluid is drawn from a sump tank 306, through a line 308, to a pump 309, that discharges the fluid to a flow divider 310. Fluid is discharged from the flow divider, to a valve stack 311, by a line 312 and a line 313. The line 312 couples one flow divider discharge to a directional valve 314, that is controlled by an extender drum control lever 315. The line 313 couples the other flow divider discharge to a directional valve 316 that is controlled by a boom pendant payout lever 317, to a line 318 that is coupled to a directional valve 319 with a lever control 320 to extend and retract the live mast cylinders, and to a dump line 321 that extends through each directional valve to a sump return line 322. A pressure relief valve 323 is connected between the lines 321 and 322, at a location upstream of valve 319, and a pressure relief valve 324 is connected between the lines 321 and 322 at a location upstream of the valve 314. A line 325 connects the line 312 to the line 321, at the same location as the valve 324 is connected to the line 321.

The directional valve 319 is connected by an extend line 327 to a flow divider 328, that supplies fluid pressure to a line 329, for extending the live mast hydraulic cylinder 196, and to a line 330, for extending the live mast hydraulic cylinder 197. A shut-off valve 331 is connected between the lines 329 and 330 and this valve can be shifted, to equalize pressure between the lines, by a solenoid that is actuated by an electrical control line 332 from the lever control 320. The directional valve 319 is also connected to a retract line 333 and a discharge line 334. The line 333 supplies fluid for retracting the cylinder 196 and this line is coupled to a line 335, that supplies fluid for retracting the cylinder 197. Within the cylinder 196 is a lock valve 336, that is pilot operated by pressure in the line 329. Similarly, within the cylinder 197 is a lock valve 338, that is pilot operated by pressure in the line 330. The directional valve 319 has a cylinder extend position **319*a*, a neutral position 319*b*, and a cylinder retract position 319*c***.

The directional valve 316 is connected to a pendant rope payout line 341, a pendant rope inhaul line 342, and a discharge line 343, in addition to the lines 321 and 313. The pendant rope payout line is connected to the hydraulic motor 200 and the pendant rope inhaul line is connected, through a holding valve 344, to the hydraulic motor. The discharge line is connected to the sump return line 322. The directional valve has a neutral position **316*b*, wherein the line 321 is open through the valve, the line 313 is blocked, and the lines 341 and 342 are interconnected with each other and with the line 343. In a valve position 316*a* for paying out the pendant rope line, the line 321 is blocked, the lines 313 and 341 are connected, and the lines 342 and 343 are connected. In a valve position 316*c* for inhauling the pendant rope line, the line 321 is blocked, the lines 341 and 343 are connected, and the lines 313 and 342** are connected.

The directional valve 314 is connected to an extender rope inhaul line 347, an extender rope payout line 348, and a discharge line 349, in addition to the lines 321 and 312. The extender rope inhaul line is connected through a holding valve 350 to the hydraulic motor 84, and the extender rope payout line is also connected to the hydraulic motor. The discharge line is connected to the sump return line 322. The directional valve has a neutral position **314*b*, wherein the line 321 is open through the valve, the line 312 is blocked, and the lines 347 and 348 are interconnected with each other and with the line 349. In a valve position 314*a* for paying out the extender rope, the line 321 through the valve position is blocked, the lines 312 and 348 are connected through the valve, and the lines 347 and 349 are connected through the valve. Flow from line 321 is diverted through line 325, to line 312, and then through the directional valve, when line 321 through the valve position is blocked. In a valve position 314*c* for inhauling on the extender rope, the line 321 through the valve position is blocked, the lines 312 and 347 are connected through the valve, and the lines 348 and 349** are connected through the valve.

The pendant rope inhaul line 342 and the extender rope payout line 348 are interconnected, through a shuttle valve 352, to an extender motor brake release line 351, that is connected to the hydraulic motor 84. Thus, it will be seen that the brake is released when either the line 348 or the line 342 is pressurized, but when neither line is pressurized, the brake is set.

The extender rope inhaul line 347 and the pendant rope payout line 341 are interconnected, through a shuttle valve 356, to a pendant motor brake release line 357, that is connected to the hydraulic motor 200. Thus, it will be seen that the brake is released when either the line 341 or the line 347 is pressurized, but when neither line is pressurized, the brake is set. A hydraulic pilot line 358 is connected from the line 341, to release the holding valve 344 and the pressure retained in the pendant rope inhaul line 342, when the pendant rope payout line is pressurized. This holding valve acts as a tensioning device by allowing the boom pendant 186 to be pulled off the pendant storage drum 187 only when enough pressure is created to overcome the holding valve setting. A vent line 362 connects both the motor 84 and the motor 200 to the sump tank 306.

In operation, the extensible boom 29 is supported by the boom carrying ropes 192 and 193 during traveling, boom extending, and boom retracting, but the boom pendant 186 supports the boom when lifting a load. The live masts 178 and 179 are in the lower position, shown in solid line in FIG. 2, to reduce the overall height for clearance purposes during traveling between job sites. To position the live masts in the working position, shown in phantom line in FIG. 2, the crane operator first pays out the boom hoist wire rope 183, to lower the boom tip to the ground, for supporting the boom. Then, the operator moves the lever control 320 to extend the actuating arms, from the live mast hydraulic cylinders 196 and 197, which in effect increases the lengths of the boom carrying ropes 192 and 193. The pendant control lever 317 is positioned to pay out the boom pendant, which must remain slack, and the live masts are raised to an angle of approximately 45° to the centerline of the boom, by inhauling the boom hoist wire rope 183. With the live masts so positioned, the boom carrying ropes become tensioned and further inhauling on the boom hoist wire rope raises the boom tip off the ground.

The extensible boom 29 can now be extended or retracted in either a horizontal position, a position at maximum boom angle which is upwardly inclined at an angle of approximately 80° to the horizontal, or any intermediate position. Since the pins that lock adjacent boom sections together are loaded differently by the boom sections when these sections are in various boom positions, it is necessary to take some compensating steps for aligning the boom sections before moving the pins. When the boom is extended at the maximum boom angle, no compensating steps are necessary, but when the boom is retracted in that position, it is necessary to tighten the extender wire rope 56 to unload the pins. When the boom is extended in a horizontal position, the boom tip must be lowered to the ground, to align the boom sections before seating the bottom pins at the proximate end of each boom section. When the boom is retracted in a horizontal position, the boom tip must the lowered to the ground before unpinning the pins at the proximate end of each boom section. While the boom can be extended or retracted in any intermediate position, compensating steps, such as tightening the extender wire rope 56, elevating the boom to maximum boom angle, or lowering the boom tip to the ground, might be necessary for aligning the boom sections, before moving the pins.

Assuming that the extensible boom 29 is fully retracted and that the boom is supported by the boom carrying ropes 192 and 193, the boom is extended by the following procedure. First, withdraw the pins 90 and 91 at the distal end of the base section 32. This is achieved by moving the pin cylinder selector lever 221 to position the valve 220 in the valve position **220*a* that activates the pin cylinders at the distal ends of the boom sections. The pin sequence switch 237 is moved to the boom extend contact 260 and the pin function switch 236 is moved to the pin retract contact 239. After the pins 90 and 91 have been withdrawn, extend the boom section 36 by moving the extender drum control lever 315 to position the directional valve 314 in the valve position 314*c* and thereby pressurize the line 347. The boom section 36 is extended until the stop blocks S at the proximate end of this section contact the pin connecting hubs on the forward transition of the boom section 32. Then, the pins 92 and 93 at the proximate end of boom section 36 are seated within the pin connecting hub openings 94 and 95 by moving the pin cylinder selector lever 221 to the valve position 220*b*, that activates the pin cylinders at the proximate ends of the boom sections, and moving the pin function switch 236 to the pin extend on contact 238, while the pin sequence switch 237 remains on the boom extend contact 260. After the boom sections 32 and 36 are pinned together in an extended position, tension in the extender wire rope 56 is released by moving the extender drum control lever 315 to position the valve 314 with the valve position 314*a*** in operation.

Now, the boom section 39 will be extended in relationship to the boom section 36 by withdrawing the pins 96 and 97 in the same manner as the pins 90 and 91 were withdrawn. Then, the boom section 39 is extended, as was the boom section 36, and the pins 98 and 99 are seated within the pin connecting hub openings 100 and 101, by the same steps as were used to set the pins 92 and 93. Again, tension is removed from the extender wire rope 56.

In like manner, the boom section 43 is extended in relationship to the boom section 39. The pins 102 and 103, at the distal end of boom section 39, are withdrawn, and the boom section 43 is extended. The pins 104 and 105 are seated in the pin hub connection openings 106 and 107, and tension is removed from the extender wire rope 56.

After the extensible boom 29 has been fully extended and the boom sections have been pinned together, the live masts 178 and 179 are repositioned at an angle of approximately 45° to the centerline of the boom. The boom pendant 186 is tightened by moving the pendant control lever 317 so that the valve position **316*a* is in operation and the pendant motor 200 is energized to inhaul on the boom pendant. Then, the pawls, not shown, are set to engage the ratchet wheels 204 and 205, to lock the pendant storage drum 187 in position, and the lever 317 is returned to the neutral valve position 316*b*. The live mast hydraulic cylinders 196 and 197 are extended, by moving the lever control 320 so that the valve position 319*a* is in operation within the hydraulic circuit. Extension of these cylinders slackens the boom carrying ropes 192 and 193, and the boom is supported by the boom pendant 186. Now, the lever control 320 is returned to the neutral valve position 319*b***, and the boom is ready for lifting a load.

Retraction of the extensible boom 29 is basically the opposite procedure from extension, with the exception that the boom sections have to be pulled in with the boom pendant 186. First, retract the live mast hydraulic cylinders 196 and 197, by moving the lever control 320 to place the valve position **319*c* in operation. Retraction of these cylinders tightens the boom carrying ropes 192 and 193 and slackens the boom pendant 186 so that the boom is fully supported by the boom carrying ropes. Then, retract or withdraw the pins 104 and 105 by moving the pin cylinder selected lever 221 to position the valve 220 with the valve position 220*b* in operation, moving the pin sequence switch 237 to the boom retract contact 263, and moving the pin function switch 236 to the pin retract contact 239. After the pins 103 and 105 have been retracted, retract the boom section 43 by moving the boom pendant control lever 317 to position the directional valve 316 so that the valve position 316*c* is in the circuit. When the boom section 43 is completely retracted, the pins 102 and 103 are set by moving the pin cylinder selector lever 221 to position the valve 220 with the valve position 220*a* in the circuit and moving the pin function switch to the pin extend contact 238, while the pin sequence switch 237 remains on the boom retract contact 263**.

Now, the boom section 39 will be retracted into the boom section 36 by first retracting the pins 98 and 99, in the same manner as the pins 104 and 105 were retracted. Then, retract the boom section 39, as the boom section 43 was retracted, and seat the pins 96 and 97 as the pins 102 and 103 were set.

In like manner, the boom section 36 is retracted into the boom section 32. The pins 92 and 93, at the proximate end of boom section 36, are retracted from the pin connecting hub openings 94 and 95. The boom section 36 is retracted, and the pins 90 and 91, at the distal end of the base section 32, are seated.

With the extensible boom 29 in a fully retracted position, the boom can be prepared for traveling to another job site by lowering the boom tip to the ground for support, lowering the live masts 178 and 179 to the travel position, shown in solid line in FIG. 2, and simultaneously inhauling on the boom pendant 186. The boom pendant is inhauled by moving the pendant control lever 317 to position the valve 316 with the valve position 316c in the hydraulic circuit and the boom and live masts are lowered by the boom hoist wire rope 183. With the live mast lowered, the live mast hydraulic cylinders 196 and 197 are retracted completely by moving the control lever 320 to place the valve position 319c in operation. Such retraction of these hydraulic cylinders tightens the boom carrying ropes 192 and 193 for supporting the boom, that can now be raised by the boom hoist wire rope 183 to a horizontal position for traveling.

From the foregoing description it will be seen that the extensible boom 29 is supported by a cable suspension system and can be extended or retracted at a desired boom angle without having the support cables apply significant loads to the movable boom sections. The boom sections are pinned together in either extended or retracted positions at the control of a crane operator and the pinning of these sections enables the boom to act as an integral unit for resisting compression axially of the boom and resisting bending moment transversely of the longitudinal axis of the boom. The movable boom sections are supported from their proximate or base ends as cantilevers during extension and retraction of the boom, but after the sections have been pinned together at a desired length for operation, the tip of the boom is supported by a boom pendant. Flags are provided to automatically indicate, to the crane operator, the positions of the pins that lock the movable boom sections together. A pair of live masts 178 and 179, that support a boom pendant 186 and a pair of boom support wire ropes 192 and 193, can be elevated to a position for providing the necessary support to operate the boom or can be lowered to a position that supports the boom while traveling. Hydraulic motors act as torque motors, to put a drag on the extender wire rope 56 and the boom pendant 186 as these lines are paid out, and thus, maintain a proper amount of slack in these lines.

Although the best mode contemplated for carrying out the present invention has been herein shown and described, it will be apparent that modification and variation may be made without departing from what is regarded to be the subject matter of the invention.

What is claimed is:

1. In a crane or the like, the combination comprising an extensible boom having at least two sections that include a fixed base section and a movable tip section, means for extending the tip section relative to the base section, means for pinning said boom sections together to resist bending transversely of the longitudinal axis of the boom in a generally vertical plane and to resist compression axially of the boom, a boom pendant connected to the distal end of the tip section, means for maintaining slack in the boom pendant while the tip section is being extended, means for tensioning the boom pendant to support the distal end of the boom when the boom sections are pinned together for supporting loads with the boom, said boom pendant slack maintaining means including a pendant storage drum about which a portion of the boom pendant is wrapped and a hydraulic motor that pays out the boom pendant only in response to a given pressure, said pendant storage drum being located at the proximate end of the base section, and a live mast assembly being connected to the proximate end of the base section for pivotal movement upwardly of the boom about a horizontal axis, said live mast assembly supporting the boom pendant between the distal end of the tip section and the pendant storage drum.

2. The combination described in claim 1 which further includes a boom carrying rope connected to the distal end of the base section for supporting the base section as the boom is being extended or retracted, said boom carrying rope being supported by the live mast assembly.

3. The combination described in claim 2 which further includes a boom carrying rope slackening and tensioning mechanism mounted on the live mast assembly.

4. The combination described in claim 3 wherein said boom carrying rope slackening and tensioning mechanism includes a hydraulic cylinder with an actuator arm for engaging a bight of the boom carrying rope on the opposite side of the live mast assembly from the reach of the boom carrying rope that extends from the live mast assembly to the distal end of the base section.

5. The combination described in claim 4 wherein said hydraulic cylinder is connected to the live mast assembly and extends substantially parallel therewith.

6. The combination described in claim 5 which further includes a boom hoist for changing the boom angle independently of the boom pendant and the boom carrying rope, said boom hoist being connected to the live mast assembly.

7. In a crane or the like, the combination comprising a machinery platform; an extensible boom having a base end pivotally connected to the machinery platform for rotation about a horizontal axis, a tip end opposite the base end, and at least two sections in longitudinal telescopic relationship with each other; means for extending the tip section relative to the base section; means for pinning said boom sections together to resist bending in a generally vertical plane transversely of the longitudinal axis of the boom and to resist compression axially of the boom; a live mast assembly being connected to the base end of the boom for pivoting upwardly from the boom about a horizontal axis; a boom hoist being connected to the live mast assembly for elevating the live mast assembly and the boom; a boom pendant being connected to the distal end of the tip section and extending over the live mast assembly to the base end of the boom; a boom pendant storage drum being located at the base end of the boom for receiving one end of the boom pendant; a boom carrying rope being connected to the distal end of the base section and extending over the live mast assembly; and a boom carrying rope slackening and tensioning mechanism being mounted on the live mast assembly for engaging the boom carrying rope.

8. In a crane or the like, the combination comprising an extensible boom having at least two sections that include a fixed base section and a movable tip section, means for extending the tip section relative to the base section, means for pinning said boom sections together to resist bending transversely of the longitudinal axis of the boom in a generally vertical plane and to resist compression axially of the boom, a boom pendant connected to the distal end of the tip section, means for maintaining slack in the boom pendant while the tip section is being extended, means for tensioning the boom pendant to support the distal end of the boom when the boom sections are pinned together for supporting loads with the boom, a boom carrying rope connected to the distal end of the base section for supporting the base section as the boom is being extended or retracted, means for slackening the boom carrying rope when the boom pendant is tensioned to support the distal end of the boom, said means for slackening the boom carrying rope and said means for tensioning the boom pendant being operable simultaneously in response to a single control, and a boom hoist rope for raising and lowering the boom independently of the boom pendant and the boom carrying rope.

9. The combination described in claim 8 further including pin position indicator flags that are mounted at more readily visible locations than the boom section pinning means to indicate whether or not the boom sections are pinned together.

10. The combination described in claim 9 wherein said pin position indicator flags are mounted for pivotal movement between a plurality of positions, said boom section pinning means including hydraulic cylinders with piston rods, and flexible control cables operably connecting the piston rods with the pin position indictor flags to move the flags in response to movement of the piston rods.

* * * * *